US010274276B2

(12) United States Patent
Full

(10) Patent No.: US 10,274,276 B2
(45) Date of Patent: Apr. 30, 2019

(54) FOLDING PISTOL

(71) Applicant: Full Conceal Inc., Las Vegas, NV (US)

(72) Inventor: Michael Full, Dublin, CA (US)

(73) Assignee: FULL CONCEAL, INC., Las Vegas, NV (US)

( * ) Notice: Subject to any disclaimer, the term of this patent is extended or adjusted under 35 U.S.C. 154(b) by 0 days.

(21) Appl. No.: 16/043,499

(22) Filed: Jul. 24, 2018

(65) Prior Publication Data

US 2019/0033026 A1 Jan. 31, 2019

Related U.S. Application Data

(60) Provisional application No. 62/537,466, filed on Jul. 27, 2017.

(51) Int. Cl.
*F41A 11/04* (2006.01)
*F41C 9/02* (2006.01)
*F41C 23/10* (2006.01)

(52) U.S. Cl.
CPC ..... *F41A 11/04* (2013.01); *F41C 9/02* (2013.01); *F41C 23/10* (2013.01)

(58) Field of Classification Search
CPC ..... F41A 11/04
USPC ..... 42/16
See application file for complete search history.

(56) References Cited

U.S. PATENT DOCUMENTS 1,059,405 A * 4/1913 Sprague ..... F41A 3/58 42/8
3,979,850 A * 9/1976 Schiessl ..... F41A 11/04 42/71.02
4,625,621 A * 12/1986 Warin ..... F41C 9/02 42/1.09
8,006,425 B2 * 8/2011 Burt ..... F41A 3/66 42/1.09
9,945,629 B2 * 4/2018 Osborne ..... F41A 9/17
2010/0242329 A1 9/2010 Carr et al.
2017/0205186 A1 * 7/2017 Kjellberg ..... F41C 9/02

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A folding pistol has a frame having slide rails adapted to receive a slide, a grip defining a magazine passage pivotally connected to the frame at a first pivot and having a free end extending away from the first pivot, the grip being movable between an extended position in which the pistol is operable, and a stowed position in which the free end of the grip is adjacent the frame, a forward trigger guard element pivotally connected to the frame at a second pivot, a lower trigger guard element connected to the forward trigger guard element at a third pivot, and the lower trigger guard element connected to the grip at a fourth pivot. The first, second, third, and fourth pivots may be at different locations. There may be a trigger connected to the frame at a selected one of the first, second, third, and fourth pivots.

15 Claims, 7 Drawing Sheets

FOLDING PISTOL

CROSS-REFERENCE TO RELATED APPLICATION

This application claims the benefit of U.S. Provisional Patent Application No. 62/537,466 filed on Jul. 27, 2017, entitled "FOLDING HANDGUN & GRIP EXTENSION SECTIONS," which is hereby incorporated by reference in its entirety for all that is taught and disclosed therein.

FIELD OF THE INVENTION

The present invention relates to firearms, and more particularly to a pistol that folds into a compact shape for storage or transport that is not readily identifiable as a handgun. The folding capability also provides a large physical and visual safety mechanism when the pistol is in the folded condition that supplements an additional mechanical safety that functions when the pistol is partially or fully unfolded.

BACKGROUND OF THE INVENTION

Concealed carry is the practice of carrying a firearm, usually a handgun, in public in a concealed manner. All 50 states in the US have laws allowing qualified individuals to carry certain concealed firearms in public, either without a permit or after obtaining a permit. Published statistics indicate the number of concealed carry permit holders in the United States is steadily increasing.

Small caliber and small frame handguns that will fit in a pocket are particularly popular for concealed carry. A significant disadvantage to these firearms is they are easily recognized as being a handgun in the carrier's pocket because of their very identifiable, distinct L-shaped pistol silhouette. In addition, because of their characteristic handgun form, they often turn and twist in different directions in the carrier's pocket, making a smooth draw awkward. Conventional pocket carry handguns when carried in a pocket unchambered with a holster apply pressure solely on the barrel in the pocket, which can break the pocket's seams. If a conventional pocket carry handgun is carried with a round chambered, the handgun must be carried inside a holster to prevent accidental discharge. Otherwise, the handgun could discharge if the user were to bump into something that could engage the trigger, such as a table corner, or if the trigger were inadvertently actuated when the user was retrieving the handgun from his or her pocket. The holster adds bulk and requires an additional removal step before the handgun can be operated. Additionally, small pocket carry handguns are often "snappy," having excess muzzle rise that makes maintaining the sight picture difficult, and the grips are often too small or awkward to grasp. Another negative aspect is the magazine capacity of small pocket carry firearms is generally limited to relatively few rounds because a higher capacity magazine may not fit in the user's pocket or can be harder to draw from the user's pocket. If an extra magazine is needed, it must be carried either in another pocket or a holster of some sort that requires the carrier to divert at least one hand and his or her attention to retrieve it and reload the handgun.

To attempt to address the identifiable, distinct silhouette of a concealed carry firearm, and to enable larger handguns with greater magazine capacities to be used for concealed carry, foldable handguns have been developed. One example is the compact foldable handgun disclosed by US Patent Publication No. 2010/0242329 to Carr et al. Although the handgun of Carr et al. is generally suitable for its intended use, it has the disadvantages of additional complexity and requiring the use of a specially-designed pistol. The Carr et al. trigger guard does not connect to the grip, the trigger supports the rear of the trigger guard, and the grip and trigger do not share a common pivot pin. In contrast, the grip and trigger of the current invention share a common pivot pin to reduce complexity, the trigger guard is connected to the grip, and the current invention is readily adaptable for use with an existing, conventional pistol.

Therefore, a need exists for a new and improved folding pistol that is not readily identifiable as a handgun, reduces complexity of the folding mechanism, can be used with existing, conventional pistols, and provides a large physical and visual safety mechanism when the pistol is in the folded condition. In this regard, the various embodiments of the present invention substantially fulfill at least some of these needs. In this respect, the folding pistol according to the present invention substantially departs from the conventional concepts and designs of the prior art, and in doing so provides an apparatus primarily developed for the purpose of not being readily identifiable as a handgun, reducing complexity of the folding mechanism, being used with existing, conventional pistols, and providing a large physical and visual safety mechanism when the pistol is in the folded condition.

SUMMARY OF THE INVENTION

The present invention provides an improved folding pistol, and overcomes the above-mentioned disadvantages and drawbacks of the prior art. As such, the general purpose of the present invention, which will be described subsequently in greater detail, is to provide an improved folding pistol that has all the advantages of the prior art mentioned above.

To attain this, the preferred embodiment of the present invention essentially comprises a frame having slide rails adapted to receive a slide, a grip defining a magazine passage pivotally connected to the frame at a first pivot and having a free end extending away from the first pivot, the grip being movable between an extended position in which the pistol is operable, and a stowed position in which the free end of the grip is adjacent the frame, a forward trigger guard element pivotally connected to the frame at a second pivot, a lower trigger guard element connected to the forward trigger guard element at a third pivot, and the lower trigger guard element connected to the grip at a fourth pivot. The first, second, third, and fourth pivots may be at different locations. There may be a trigger connected to the frame at a selected one of the first, second, third, and fourth pivots. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
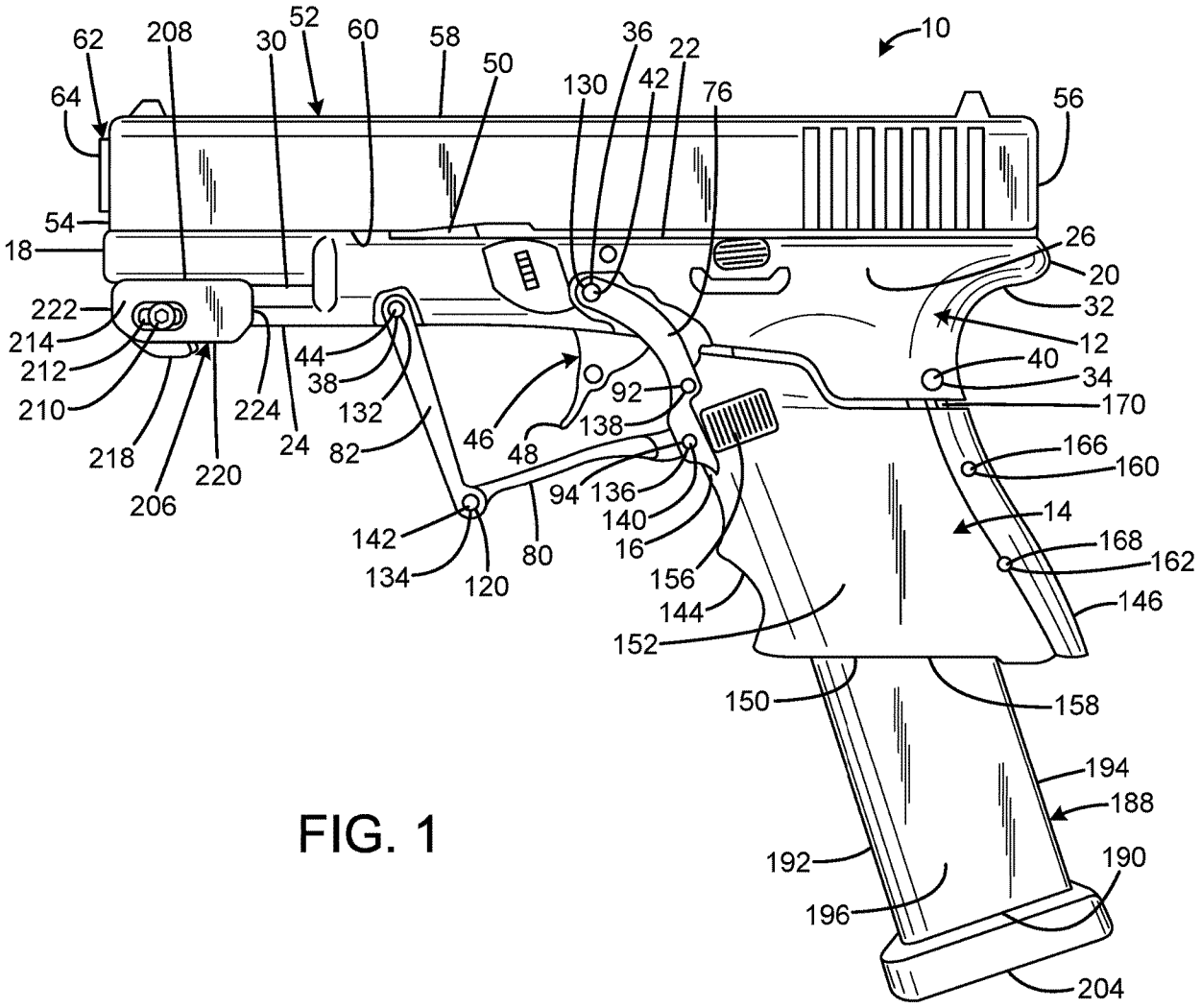
FIG. 1 is a left side view of the current embodiment of the folding pistol constructed in accordance with the principles of the present invention with the grip in the extended position, which makes the pistol operable to fire.

An embodiment of the folding pistol of the present invention is shown and generally designated by the reference numeral 10.

FIGS. 1-7 illustrate the improved folding pistol 10 of the present invention. More particularly, in the current embodiment, the folding pistol is a modified Glock 19 Gen4 pistol manufactured by Glock, Inc of Smyrna, Ga. This type of pistol has a 1-piece integrally molded plastic planar frame 12 including a unitary molded plastic handgrip 14 with a curved exterior to be comfortably received in a user's hand and a trigger guard 16. The folding pistol of the present invention detaches the handgrip from the frame, cuts off most of the trigger guard to leave only a small stub on the handgrip, and adds numerous slots and apertures that will be described subsequently.

Figure 3:
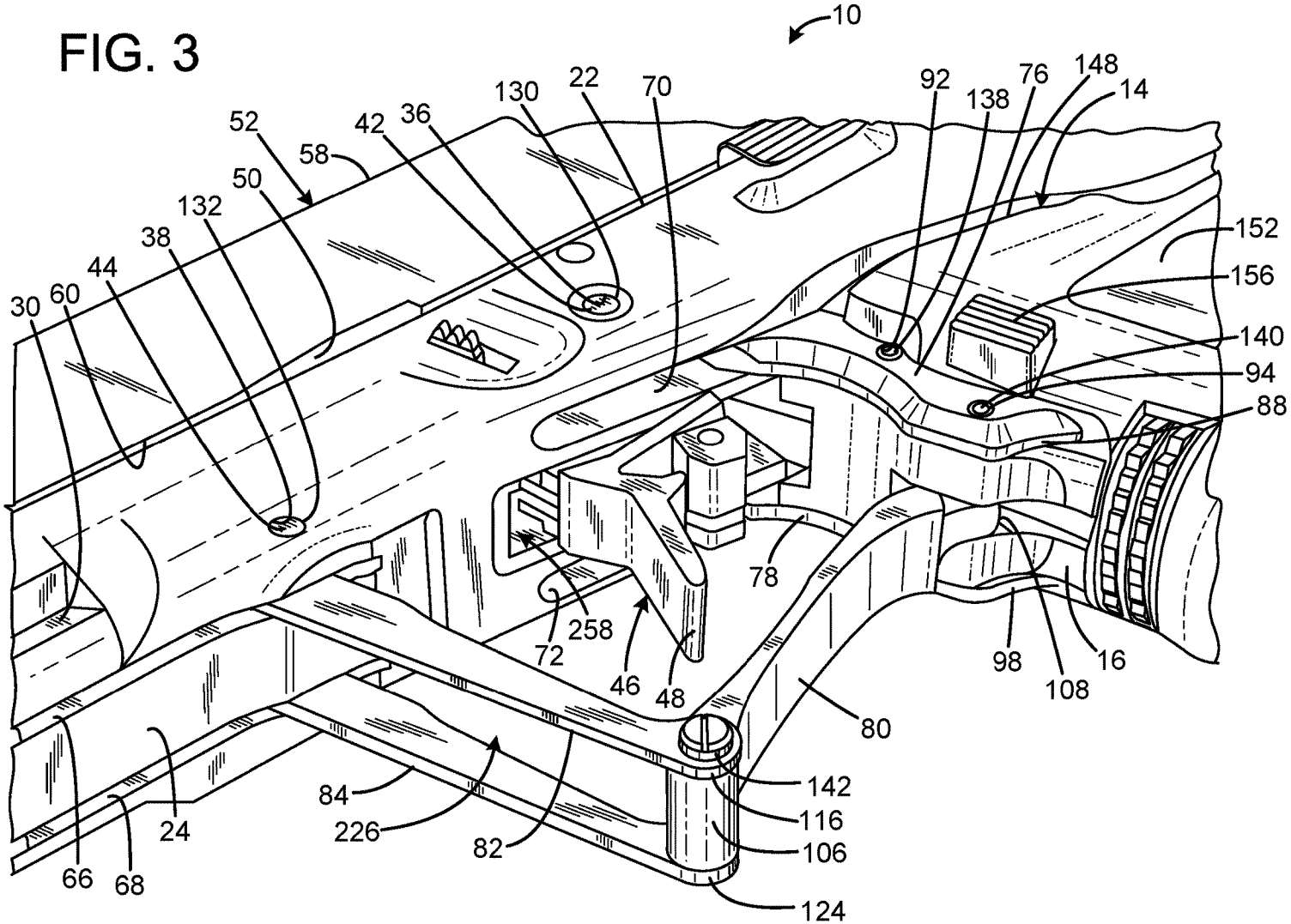
FIG. 3 is an enlarged front perspective view of the folding pistol of FIG. 1 with the grip in the extended position, which makes the pistol operable to fire.

FIGS. 1 & 3 show the folding pistol 10 with the handgrip 14 in the extended position in which the pistol is operable. The frame 12 has a front 18, rear 20, top 22, bottom 24, left side 26, and right side 28. The bottom front of the frame defines a rail 30. The bottom rear of the frame defines a beavertail 32. The left and right sides of the frame define apertures 34, 36, 38 that receive pins 40, 42, 44. Aperture 38 and pin 44 are added to the frame. Apertures 34, 36 and pins 40, 42 are pre-existing. Pin 42 attaches a trigger 46 to the frame. The trigger includes a free end 48. The top of the frame forms slide rails 50. A slide 52 is slidably mounted on the slide rails. The slide has a front 54, rear 56, top 58, and bottom 60. A barrel 62 having a muzzle 64 protrudes from the front of the slide. The bottom of the frame defines slots 66, 68 located in front of the trigger and slots 70, 72 on either side of the trigger.

The handgrip 14 is pivotally attached to the bottom 24 rear 20 of the frame 12 by a trigger guard assembly 74. The trigger guard assembly has a left rearward trigger guard element 76, right rearward trigger guard element 78, lower trigger guard element 80, left forward trigger guard element 82, and right forward trigger guard element 84. The left rearward trigger guard element has a top 86 and bottom 88. The top of the left rearward trigger guard element defines an aperture 90, and the bottom of the left rearward trigger guard element defines apertures 92, 94. The right rearward trigger guard element has a top 96 and bottom 98. The top of the right rearward trigger guard element defines an aperture 100, and the bottom of the right rearward trigger guard element defines apertures 102, 104. The lower trigger guard element has a front 106 and rear 108. The front of the lower trigger guard element defines an aperture 110, and the rear of the lower trigger guard element defines an aperture 112. The left forward trigger guard element has a top 114 and bottom 116. The top of the left forward trigger guard element defines an aperture 118, and the bottom of the left forward trigger guard element defines an aperture 120. The right forward trigger guard element has a top 122 and bottom 124. The top of the right forward trigger guard element defines an aperture 126, and the bottom of the right forward trigger guard element defines an aperture 128.

The trigger guard assembly 74 is a four-bar linkage having a first pivot 130, second pivot 132, third pivot 134, and fourth pivot 136. The first pivot includes the tops 86, 96 of the left and right rearward trigger guard elements 76, 78, pin 42, and trigger 46. Thus, the trigger is connected to the frame at the first pivot. The handgrip 14 is connected to the first pivot by the bottoms 88, 98 of the left and right rearward trigger guard elements. The bottoms of the left and right rearward trigger guard elements are secured to the handgrip by pins 138, 140 inserted through apertures 92, 94, 102, 104 in the left and right rearward trigger guard elements and apertures 248, 250 added to the small stub of the original trigger guard 16. The second pivot includes the tops 114, 122 of the left and right forward trigger guard elements 82, 84 and pin 44 (apertures 118 and 126 are the pivot points). The third pivot includes the bottoms 116, 124 of the left and right forward trigger guard elements, the front 106 of the lower trigger guard element 80, and screws 142, 252. The fourth pivot includes the rear 108 of the lower trigger guard element 80, the bottoms 88, 98 of the left and right rearward trigger guard elements, and pin 140. Thus, the lower trigger guard element is connected to the handgrip 14 at the fourth pivot. In the current embodiment, the first, second, third, and fourth pivots are at different locations. The free end 48 of the trigger is not connected to any points of the pivoting linkage, so the free end of the trigger is disconnected from the left and right forward trigger guard elements and the lower trigger guard element.

The handgrip 14 has a front strap 144, back strap 146, top 148, bottom 150, left side 152, and right side 154. The top of the left side includes a magazine latch 156 in the current embodiment. However, the magazine latch can also be on the top of the right side. The bottom of the handgrip is a free end extending away from first pivot 130. The top and bottom of the handgrip are opposed open ends defining a hollow interior magazine passage 158. The top open end of the handgrip is proximate the first pivot. The back strap defines apertures 160, 162 and slot 164, which are added. Apertures 160, 162 receive pins 166, 168. Pin 166 pivotally mounts a rear latch 170 within the slot. The rear latch has a top 172, bottom 174, front 176, and rear 178. The top front of the rear latch defines an angled surface 180 and a forward-facing notch 182. A spring 184 biases the latch such that the notch is urged forward.

The magazine passage 158 receives the top 186 of a magazine 188. In the current embodiment, the magazine is a 21-round magazine manufactured by Magpul Industries Corp. of Austin, Tex. However, any conventional, unmodified magazine suitable for use with the Glock 19 Gen4 pistol can be used, including the Glock 33 round magazine. The magazine also has a bottom 190, front 192, rear 194, and left side 196. The top of the magazine defines feed lips 198 that restrain cartridges 200. The front left of the magazine below the feed lips defines a magazine catch 202. The front right of the magazine below the feed lips defines a second magazine catch (not visible) for use when the magazine latch is located on the right side 154 of the handgrip 14. The top 148 open end of the handgrip is adapted to receive the magazine having a magazine catch with the magazine latch 156 beyond the magazine catch in a direction away from the bottom 150 free end of the handgrip. When the magazine is received within the magazine passage 158 with the handgrip in the extended position as shown in FIG. 1, the magazine latch 156 is received by the catch to releasably retain the magazine within the magazine passage. A base plate 204 is attached to the bottom of the magazine.

The top 208 of a retaining element 206 is attached to the rail 30 on the front 18 of the frame 12 by screws 210 received in slots 212 defined in the left side 214 and right side 216 of the retaining element and threadedly engaged with a hexagonal bar 228. The hexagonal bar is received by a slot 254 in the rail to prevent movement of the retaining element relative to the bar. A tooth 218 protrudes downward from the bottom 220 of the retaining element. The tooth passively retains the handgrip 14 in the stowed position. The position of the tooth is adjustable depending upon the location of screws 210 within the slots, which can be adjusted if the user wants to make it easier or harder to pull the handgrip into the extended position. The retaining element also has a front 222 and rear 224.

Figure 2:
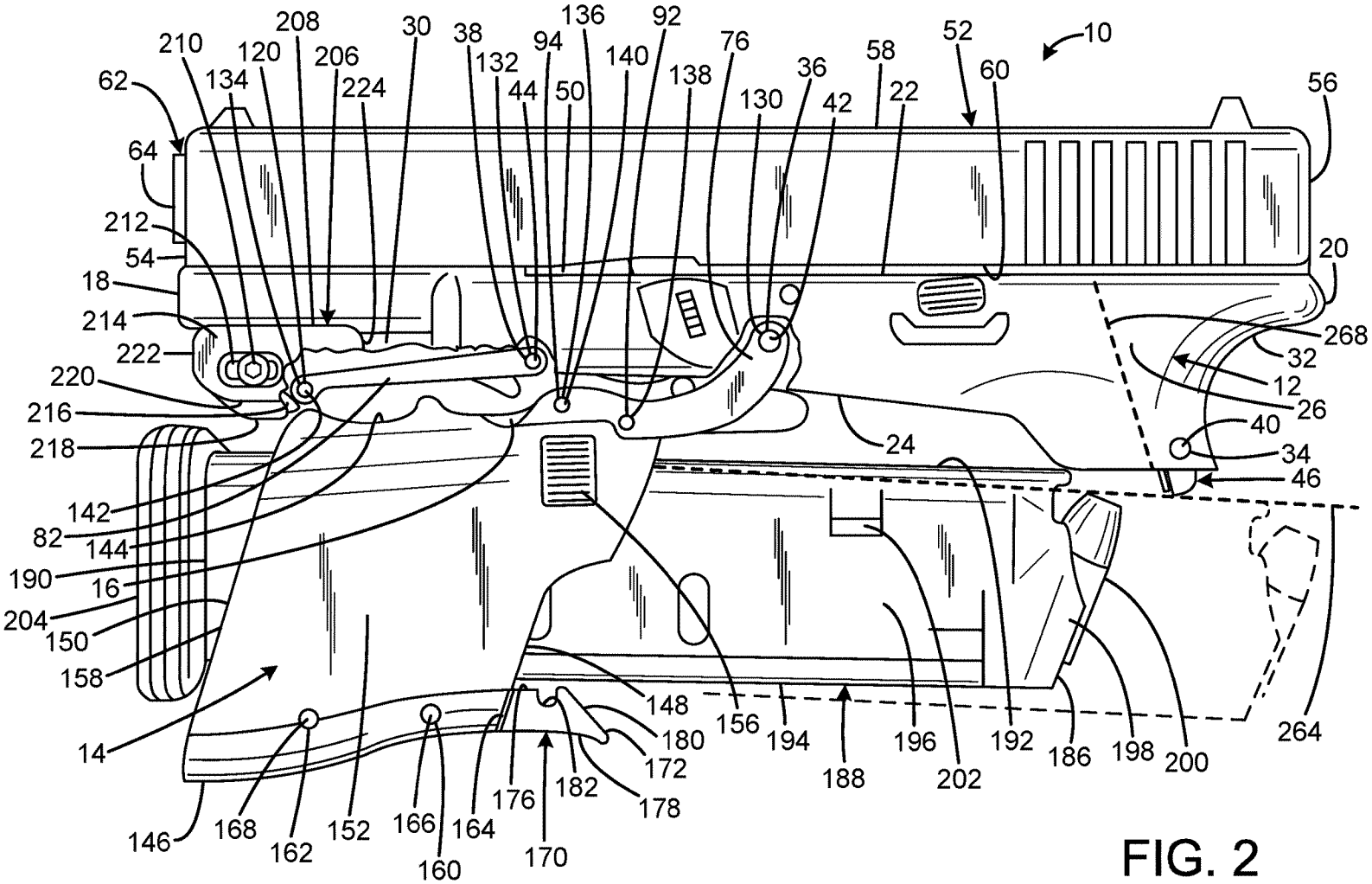
FIG. 2 is a left side view of the folding pistol of FIG. 1 with the grip in the stowed position, which makes the pistol safe and incapable of firing.

FIG. 2 illustrates the improved folding pistol 10 of the present invention. More particularly, the folding pistol is shown with the handgrip 14 in the stowed position in which the bottom 150 free end of the handgrip is adjacent the frame 12 and the pistol is inoperable. The slots 66, 68 in the bottom 24 of the frame 12 enable the left and right forward trigger guard elements 82, 84 to pivot clockwise about second pivot 132 to transition the handgrip from the extended position to the stowed position. The left and right forward trigger guard elements are a pair of spaced-apart straight elongated spans defining a gap 226. The lower trigger guard element 80 is a bar having a width sized to be received in the gap when the handgrip is in the stowed position. The slot 70, 72 in the bottom of the frame on either side of the trigger 46 enable the right and left rearward trigger guard elements 76, 78 to pivot clockwise about the first pivot 130 to transition the handgrip from the extended position to the stowed position. When the handgrip is in the stowed position, the trigger 46 folds upward into a safe position that prevents actuation of the trigger mechanism when the folding pistol is folded. Specifically, the front face of the trigger has a groove that prevents the trigger housing from moving the trigger bar 262 (shown in FIG. 7) with the handgrip in the stowed position. Therefore, as long as the trigger face is fully folded, it is mechanically impossible for the trigger bar to move to discharge the folding pistol. With the handgrip in the stowed position, the folding pistol no longer resembles a conventional L-shaped handgun. Instead, the folding pistol has a generally rectangular appearance with approximately the length and width of a large smart cellular phone. As a result, when the folding pistol is concealed, the silhouette of the folding pistol is unlikely to draw attention. The folding pistol also distributes its weight across the pocket's seams, decreasing the chance the pocket's seams will break. Furthermore, the folding pistol has a much higher capacity magazine 188 than traditional firearms considered suitable for concealed carry, especially in a pocket. A conventional sub-compact pocket carry pistol with 10 rounds has a larger rectangular footprint than the folding pistol with 21 rounds with the handgrip in the stowed position. The folding pistol also offers several advantages compared to traditional waistband concealed carry. Waistband concealed carry involves four components: a pistol (typically having a limited magazine capacity), pistol holster, spare magazine, and magazine holder. The folding pistol eliminates the need for a holster, spare magazine, and magazine holder because of its inherently safe condition when folded and its ability to accommodate high capacity magazines that decrease the need to reload. The folding pistol also provides a smaller, rectangular footprint and is thinner than a conventional pistol suitable for waistband concealed carry.

In the stowed position, the magazine passage 158 of the handgrip 14 has a selected surface facing away from the frame 12 when the handgrip is in the stowed position denoted by the forward portion of dashed line 264. The rear portion of the dashed line 264 beyond the top 148 of the handgrip 14 denotes a surface against which the top 186 of the magazine 188 slides to guide the magazine into position when the handgrip is unfolded. In the stowed position, the frame has a rear portion rearward of the first pivot 130, and the entire rear portion remains above the selected surface of the magazine passage of the handgrip, such that the elongated magazine 188 in the magazine passage, or an even higher capacity magazine denoted by the dashed lines, can extend below the frame. It should be appreciated that the frame and parts such as the housing portion of the trigger 46 can flex to enable the top of a 33 round magazine to extend beyond the rear of the frame. Contact between the housing portion of the trigger and a high capacity magazine produces some friction when the high capacity magazine is stored this way so the stop element 230 is not required, and a user can switch the handgrip from the stowed position to the extended position with one hand.

To transition the handgrip 14 from the extended position to the stowed position, the user depresses the bottom 174 of the rear latch 170 to disengage the notch 182 from pin 40. The user can then pivot the handgrip clockwise about first pivot 130 into the stowed position. The tooth 218 snaps over the front 106 of the lower trigger guard element 80 to releasably secure the handgrip in the stowed position. For any magazines where the baseplate extends beyond the muzzle, such as the Glock 15 magazine, a Magpul 21 magazine, or a Glock 33 magazine, the user depresses the magazine latch 156 to disengage the magazine latch from the catch 202 on the magazine 188 and slides the magazine upwards until the baseplate contacts the bottom 150 of the handgrip. In this position, the magazine forms a rectangular footprint with the folded pistol. When the magazine is stored in this position, the magazine latch 156 is maintained in a depressed position by the magazine's body. So, when the magazine comes back down as the handgrip transitions from the stowed position to the extended position, the magazine latch will spring back into the magazine catch 202 and lock the magazine. This action prevents the magazine from falling out of the handgrip while the folding pistol is being transported or unfolded.

To transition the handgrip 14 from the stowed position to the extended position, the user pivots the handgrip counterclockwise about first pivot 130 to disengage the tooth 218 from the front 106 of the lower trigger guard element 80 and position the handgrip in the extended position. As the user unfolds the handgrip, the magazine passage 158 smoothly guides the magazine 188 downward as the top 186 of the magazine enters the bottom 24 of the frame 12 and contacts the back wall of the magazine well (dashed line 268).

Eventually, the top of the magazine reaches a proper operational position with the magazine latch 156 being received in the catch 202 to ensure the feed lips 198 are located at the proper height to feed the uppermost cartridge 200 into the folding pistol 10 through feed passage 256. The angled surface 180 on the rear latch 170 acts as a cam surface to push the top of the rear latch rearward as the handgrip is raised until the spring can urge the forward-facing notch 182 into engagement with the pin 40 to releasably secure the handgrip to the frame 12.

Figure 4:
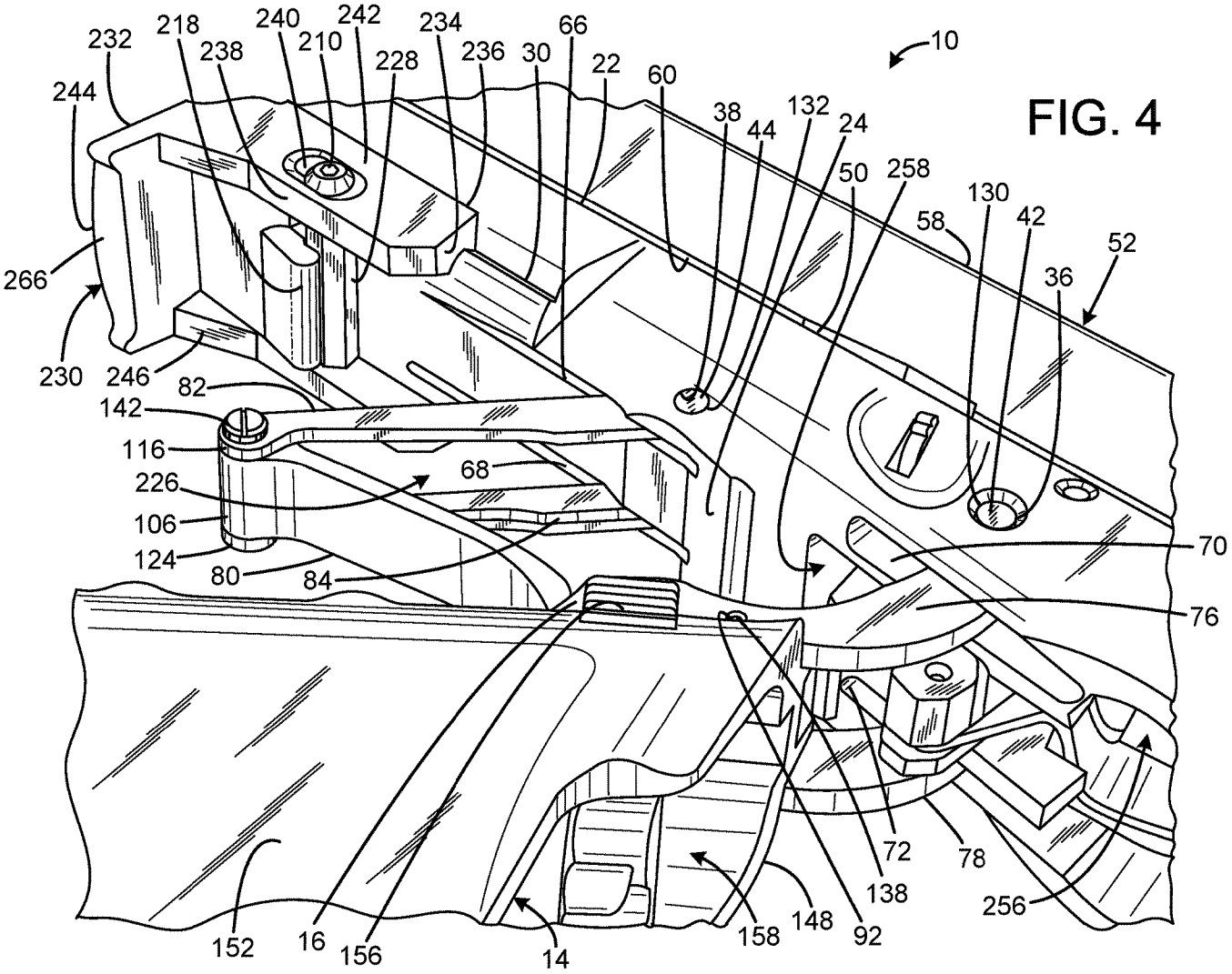
FIG. 4 is an enlarged rear perspective view of the folding pistol of FIG. 1 with the grip partially folded into the stowed position, which makes the pistol safe and incapable of firing. The magazine of FIG. 1 has been removed to expose various features of the folding pistol.
Figure 5:
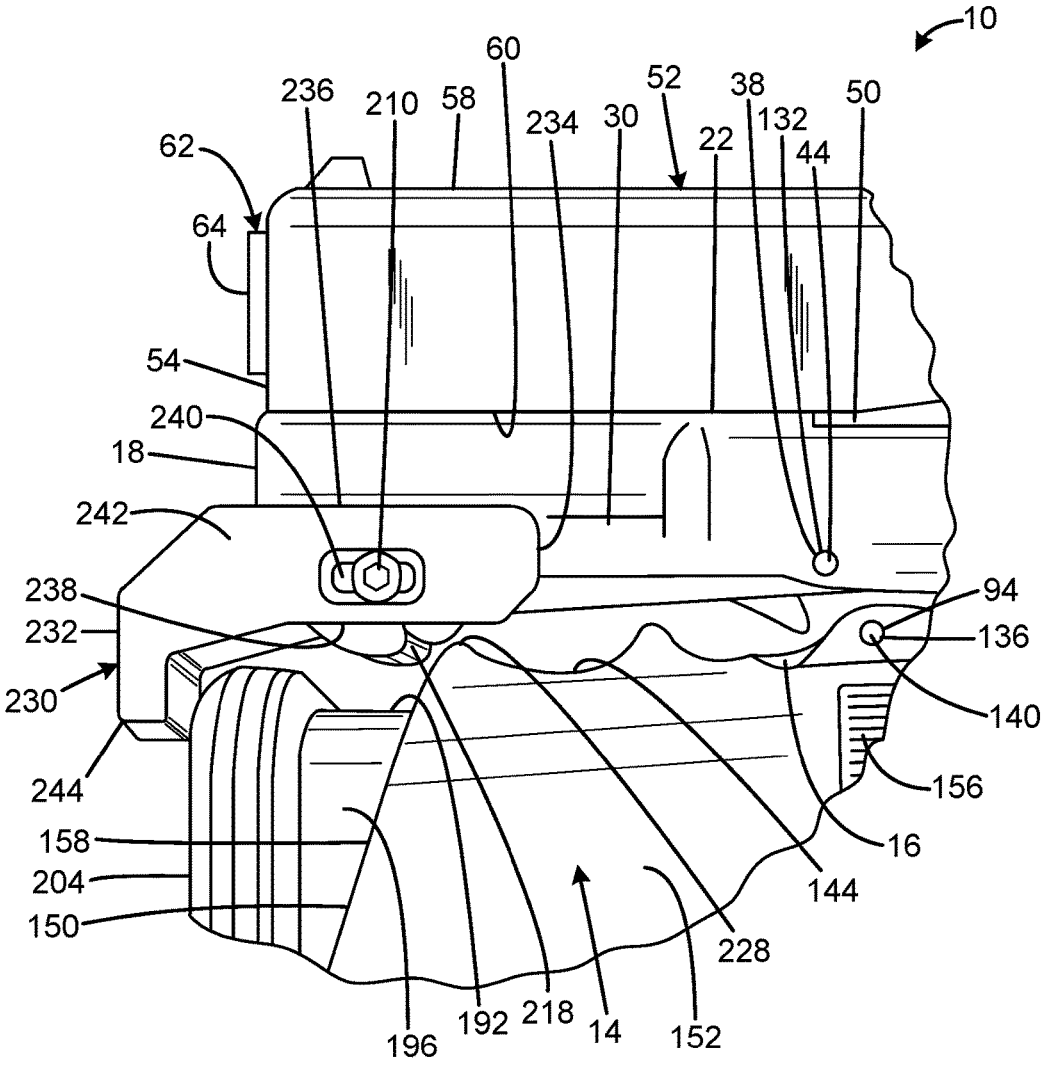
FIG. 5 is an enlarged left side view of the folding pistol of FIG. 1 with an optional stop element installed. The stop element is an optional latch element that prevents the magazine from dropping, the grip from opening, and serves as an offset so the gun does not go out of battery if pressed against an object (such as a body).
Figure 6:
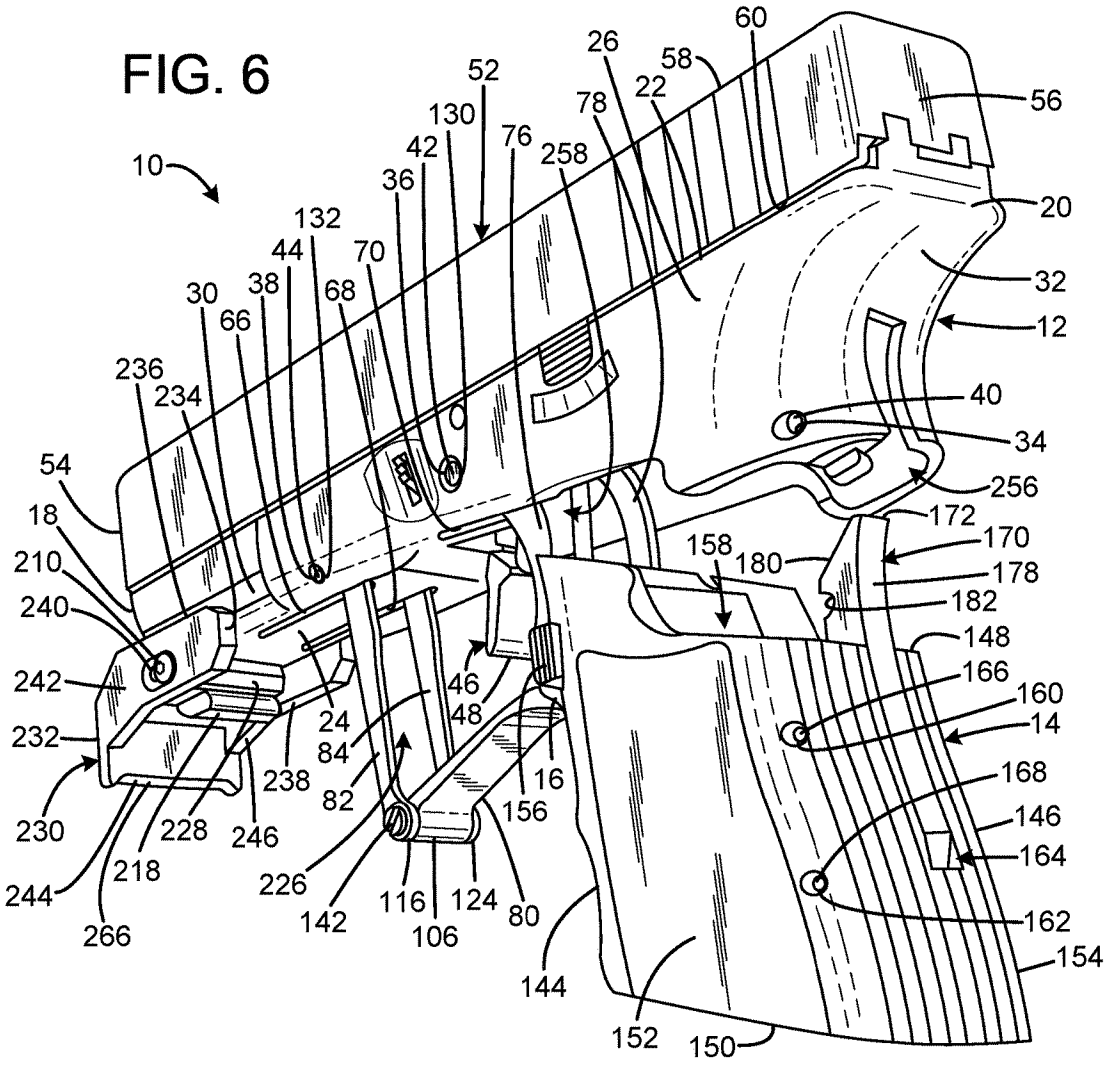
FIG. 6 is a rear perspective view of the handgrip and rear latch of the folding pistol of FIG. 1.
Figure 7:
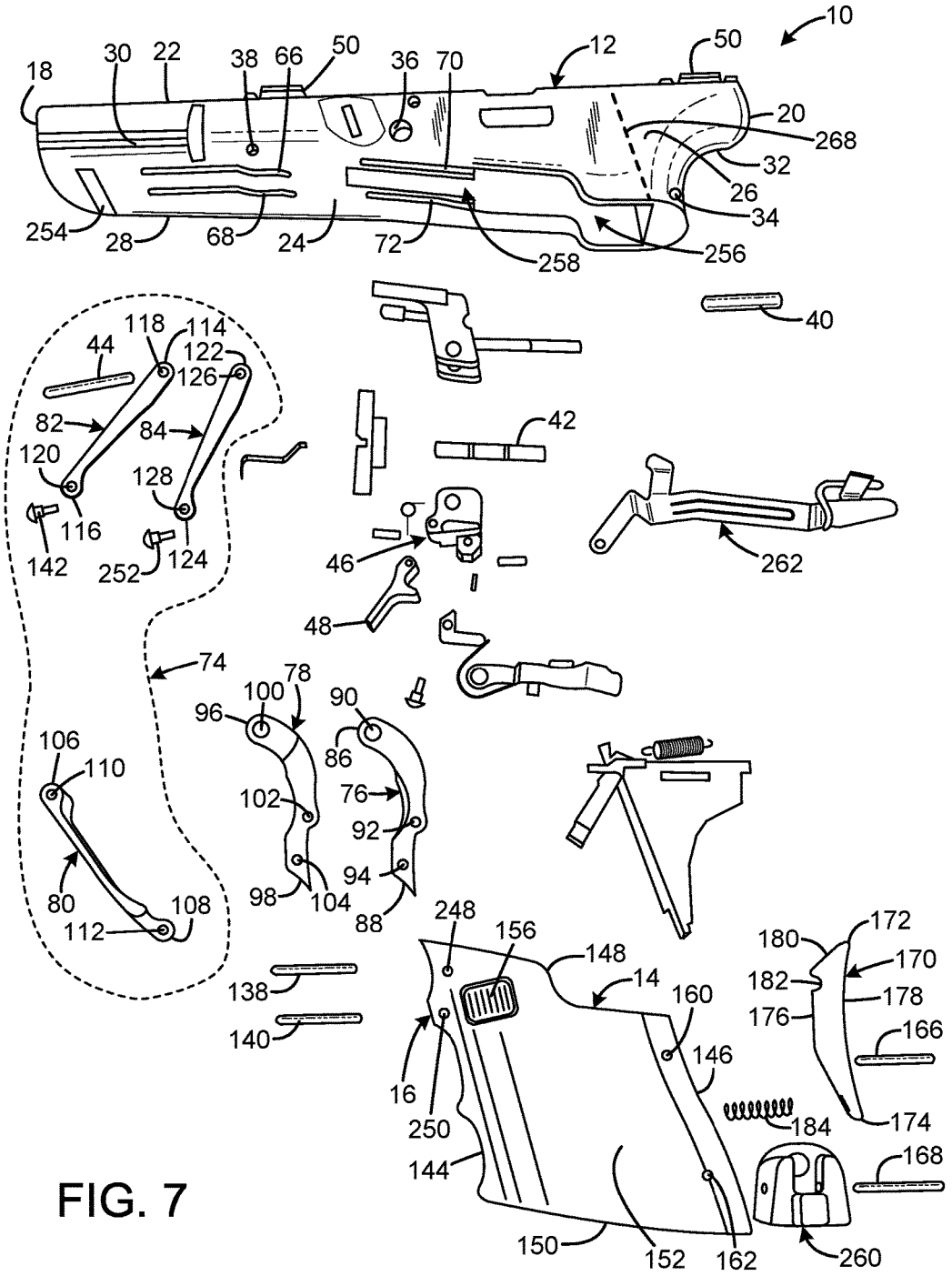
FIG. 7 is an exploded view of the folding pistol of FIG. 1.

FIGS. 4-6 illustrates the improved folding pistol 10 of the present invention. More particularly, the folding pistol is shown with an optional stop element 230 incorporated into the retaining element 206. The handgrip 14 is shown partially folded in FIG. 4, in the stowed position in FIG. 5, and partially folded in FIG. 6. The stop element has a front 232, rear 234, a top 236, and bottom 238. The stop element defines slots 240 in the left side 242 and right side 246 that receive screws 210. A protrusion 244 extends downward from the bottom front of the stop element. The bottom of the protrusion defines a groove 266. When the handgrip is in the stowed position, the protrusion contacts the baseplate 204 of the magazine 188 to prevent the magazine from moving forward beyond the protrusion. Thus, the stop element is connected to a forward portion 18 of the frame 12 away from the handgrip 14 and is adapted to extend below the frame to limit movement of the magazine in the handgrip past the muzzle when the handgrip is in the stowed position. The stop element is connected to the rail 30. Contact between the baseplate and bottom 150 of the handgrip limits upward movement of the magazine within the magazine passage. When a higher capacity 33 round magazine is used, the groove in the bottom of the stop element enables the baseplate of the higher capacity magazine to pass over the stop element. However, the stop element still helps keep the folding pistol in the stowed position and provides additional friction to keep higher capacity magazines from moving.

In the current embodiment, the first and second pivot 130, 132 define a first link length, the second and third pivot 132, 134 define a second link length, the third and fourth pivot 134, 136 define a third link length, and the fourth and first pivots 136, 130 define a fourth link length. In the current embodiment, the distance between the first and second pivots is 1.417 inch, the distance between the second and third pivots is 1.491 inch, the distance between the third and fourth pivots is 1.647 inch, and the length between the fourth and first pivots is 1.286 inch. Thus, the length of the longest of the link lengths exceeds the length of the least of the link lengths by less than 30% (28.07%). When the handgrip 14 is in the extended position, the third pivot is at a level below the fourth pivot. When the handgrip is in the extended position, the third pivot is spaced apart from the frame 12 by a greater distance than the fourth pivot is spaced apart from the frame. When the handgrip is in the extended position, the lower trigger guard element 80 is angled away from the frame, with the rear end 108 closer to the frame 12 than a forward end 106. The frame has a lower surface forward of the second pivot, and the left and right forward trigger guard elements 82, 84 remain below the lower surface when in the stowed position. The forward trigger guard elements underlay the lower surface when in the stowed position.

To manufacture the folding pistol 10, a CNC mill is used to modify a standard factory Glock 19 Gen4 frame using the following steps:

- Secure the Glock frame 12 to a fixture (vise) using the slide rails 50;
- Cut two slots 66, 68 on the bottom front of the frame and drill one hole 38 that will be the connection point of the two forward trigger guard elements 82, 84 that fold partially into the frame in the stowed position;
- Cut two slots 70, 72 for the pivot arms 76, 78 to be inserted into the frame.
- Widen the trigger pass through hole 258 in the frame to accommodate the larger folding trigger 46;
- Cut off most of the factory trigger guard 16;
- Flatten the front part of the handgrip 14 where the original factory trigger guard was connected and drill two holes 248, 250 to provide a flat surface to mount the two rearward trigger guard elements 76, 78;
- Cut a slot 164 on the back strap 146 of the handgrip to accommodate the rear latch 170 that latches the handgrip to the frame;
- Drill two holes 160, 162 in the handgrip, one receiving pin 166 to hold the rear latch and be its pivot point (160) and the second hole (162) receiving pin 168 to capture a polymer rear latch plug 260 inserted into a hole (not visible) in the bottom 150 of the handgrip behind the magazine passage 158 that positions the latch spring 184 to keep the latch spring from moving and possibly falling out as well as keeping debris out;
- Cut the length of the original handgrip (this is optional depending on the model of the pistol), because when the pistol is folded into the stowed position, the bottom of the handgrip is flush with the muzzle 64 of the barrel 62;
- Cut the handgrip completely off;
- Debur all the plastic fuzz around the cut areas on the frame; and
- Assemble the parts.

The folding pistol 10 uses the original factory Glock trigger components (including the trigger bar 262) by removing the factory polymer trigger shoe and reusing the remaining original factory Glock trigger components with the folding trigger 46. The folding pistol manufacturing process also shaves some plastic off the rear trigger housing in the area that surrounds the factory rear sear retaining pin so there is more space for the rear latch 170 to move.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a folding pistol has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a Glock 19 Gen4 pistol has been described, it should be appreciated that the principles of the invention can be applied to other Glock pistol models or any other suitable type of pistol. Furthermore, the principles of the present invention can also be applied to a purpose-built firearm or firearm frame having been manufactured with some or all of the required shapes and apertures initially, where fewer or no additional machining steps are needed prior to installation of the components enabling the folding capability and additional safety feature.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A folding pistol comprising:

a frame having slide rails adapted to receive a slide;

a grip defining a magazine passage pivotally connected to the frame at a first pivot and having a free end extending away from the first pivot;

the grip being movable between an extended position in which the pistol is operable, and a stowed position in which the free end of the grip is adjacent the frame; a forward trigger guard element pivotally connected to the frame at a second pivot; a lower trigger guard element connected to the forward trigger guard element at a third pivot; and the lower trigger guard element connected to the grip at a fourth pivot, including a trigger connected to the frame at a selected one of the first, second, third, and fourth pivots.

2. The folding pistol of claim 1 wherein the first, second, third, and fourth pivots are at different locations.

3. The folding pistol of claim 1 wherein the first and second pivot define a first link length, the second and third pivot define a second link length, the third and fourth pivot define a third link length, and the fourth and first pivot define a fourth link length, and wherein a length of the longest of the link lengths exceeds the length of the least of the link lengths by less than 30%.

4. The folding pistol of claim 1 wherein the grip includes a magazine latch, and wherein the grip has an open end proximate the first pivot and adapted to receiving a magazine having a magazine catch with the magazine latch beyond the magazine catch in a direction away from the free end of the grip.

5. The folding pistol of claim 4 wherein the magazine passage of the grip has a selected surface facing away from the frame when the grip is in the stowed position, and wherein the frame has a rear portion rearward of the first pivot and the entire rear portion remaining above the selected surface of the magazine passage of the grip, such that an elongated magazine in the magazine passage may extend below the frame.

6. The folding pistol of claim 1 wherein the forward trigger guard element is a straight elongated span.

7. The folding pistol of claim 1 wherein when the grip is in the extended position, the third pivot is at a level below the fourth pivot.

8. The folding pistol of claim 1 wherein the frame has a lower surface forward of the second pivot, and the forward trigger guard element remains below the lower surface when in the stowed position.

9. The folding pistol of claim 8 wherein the forward trigger guard element underlays the lower surface when in the stowed position.

10. A folding pistol comprising:

a frame having slide rails adapted to receive a slide;

a grip defining a magazine passage pivotally connected to the frame at a first pivot and having a free end extending away from the first pivot;

the grip being movable between an extended position in which the pistol is operable, and a stowed position in which the free end of the grip is adjacent the frame; a forward trigger guard element pivotally connected to the frame at a second pivot; a lower trigger guard element connected to the forward trigger guard element at a third pivot; and the lower trigger guard element connected to the grip at a fourth pivot, wherein the trigger is connected to the frame at the first pivot, wherein the trigger has a free end disconnected from the forward trigger guard element and the lower trigger guard element.

11. A folding pistol comprising:

a frame having slide rails adapted to receive a slide;

a grip defining a magazine passage pivotally connected to the frame at a first pivot and having a free end extending away from the first pivot;

the grip being movable between an extended position in which the pistol is operable, and a stowed position in which the free end of the grip is adjacent the frame: a forward trigger guard element pivotally connected to the frame at a second pivot; a lower trigger guard element connected to the forward trigger guard element at a third pivot; and the lower trigger guard element connected to the grip at a fourth pivot, wherein a selected one of the forward trigger guard element and the lower trigger guard element includes a pair of spaced-apart spans defining a gap, and the other of the forward trigger guard element and the lower trigger guard element is a bar having a width sized to be received in the gap when the grip is in the stowed position.

12. A folding pistol comprising:

a frame having slide rails adapted to receive a slide;

a strip defining a magazine passage pivotally connected to the frame at a first Divot and having a free end extending away from the first pivot;

the grip being movable between an extended position in which the pistol is operable, and a stowed position in which the free end of the grip is adjacent the frame; a forward trigger guard element pivotally connected to the frame at a second pivot; a lower trigger guard element connected to the forward trigger guard element at a third pivot; and the lower trigger guard element connected to the grip at a fourth pivot, wherein when the grip is in the extended position, the third pivot is spaced apart from the frame by a greater distance than the fourth pivot is spaced apart from the frame.

13. A folding pistol comprising:

a frame having slide rails adapted to receive a slide;

a grip defining a magazine passage pivotally connected to the frame at a first pivot and having a free end extending away from the first pivot;

the grip being movable between an extended position in which the pistol is operable, and a stowed position in which the free end of the grip is adjacent the frame: a forward trigger guard element pivotally connected to the frame at a second pivot; a lower trigger guard element connected to the forward trigger guard element at a third pivot; and the lower trigger guard element connected to the grip at a fourth pivot, wherein when the grip is in the extended position, the lower trigger guard element is angled away from the frame, with a rear end closer to the frame than a forward end.

14. A folding pistol comprising:

a frame having slide rails adapted to receive a slide;

a grip defining a magazine passage pivotally connected to the frame at a first pivot and having a free end extending away from the first pivot;

the grip being movable between an extended position in which the pistol is operable, and a stowed position in which the free end of the grip is adjacent the frame: a forward trigger guard element pivotally connected to the frame at a second pivot; a lower trigger guard element connected to the forward trigger guard element at a third pivot; and the lower trigger guard element connected to the grip at a fourth pivot, including a stop element connected to a forward portion of the frame away from the grip, and adapted to extend below the frame to limit movement of a magazine in the grip when the grip is in the stowed position.

15. The folding pistol of claim 14 wherein the frame includes a rail and the stop element is connected to the rail.

* * * * *